US006267127B1

(12) United States Patent
Doreste

(10) Patent No.: US 6,267,127 B1
(45) Date of Patent: Jul. 31, 2001

(54) SELF-ANCHORING BEACH UMBRELLA

(76) Inventor: Eric K. Doreste, 23 Iowa Rd., Great Neck, NY (US) 11020

( * ) Notice: Subject to any disclaimer, the term of this patent is extended or adjusted under 35 U.S.C. 154(b) by 0 days.

(21) Appl. No.: 09/513,676

(22) Filed: Feb. 25, 2000

(51) Int. Cl.[7] ..... A45B 23/00

(52) U.S. Cl. ..... 135/15.1; 52/165; 248/156; 248/530

(58) Field of Search ..... 135/15.1, 16; 52/165; 248/530, 156

(56) References Cited

U.S. PATENT DOCUMENTS

| | | |
|---|---|---|
| D. 371,901 | 7/1996 | Perls . |
| D. 394,544 | 5/1998 | Tropiano . |
| D. 402,803 | 12/1998 | Goldberg et al. . |
| 2,759,486 | 8/1956 | Pesaturo . |
| 5,457,918 | 10/1995 | Plourde . |
| 5,535,978 | 7/1996 | Rodriquez et al. . |
| 5,636,944 | 6/1997 | Buttimore . |
| 5,662,304 | 9/1997 | McDaniel . |
| 5,692,720 | 12/1997 | Griggs . |
| 5,906,077 | 5/1999 | Andiarena . |

*Primary Examiner*—Beth A. Stephan
*Assistant Examiner*—Brian E. Glessner
(74) *Attorney, Agent, or Firm*—Sherman D. Pernia

(57) ABSTRACT

A self-anchoring beach umbrella comprising an umbrella canopy and an umbrella pole. The umbrella pole having an upper member for supporting the canopy and a lower member for self-anchoring the umbrella into a ground surface. The upper member being an elongated tubular sleeve having a first end communicating with and supporting the umbrella canopy, an axial lumen formed within the elongated tubular sleeve, and a second end for receiving a pole standard into the axial lumen. The lower member being a pole standard having a length, a first end formed for insertion into the axial lumen of the elongated tubular sleeve, and a second end formed for anchoring into the ground surface. A hammer is fixed to the elongated tubular sleeve, the hammer included for transmitting an axial force applied to the elongated tubular sleeve onto an anvil. The anvil fixed to the pole standard for receiving the axial force from the hammer and transmitting it to the pole standard to anchor the pole standard into the ground surface.

6 Claims, 2 Drawing Sheets

SELF-ANCHORING BEACH UMBRELLA

FIELD OF THE INVENTION

The present invention is in the field of umbrellas for use at the beach or other locations where it is desired to provide shade or protection from the weather. More specifically, the present invention is directed to a beach umbrella that additionally provides a means for anchoring the pole of the umbrella into a beach or ground surface.

BACKGROUND OF THE INVENTION

The harmful and damaging effects of the sun's ultraviolet rays have been well documented. These effects can be intensified at the beach. Umbrellas are often used to provide protection from both weather and the damaging ultraviolet rays of the sun, especially at the beach. These umbrellas typically include an umbrella canopy and an umbrella pole. In some instances, it is desired to anchor the umbrella pole into a ground or beach surface. In these instances, the canopy is attached to the top end of the umbrella pole, and the other end of the pole is typically anchored into a ground surface. Anchoring an umbrella's pole into a ground surface eliminates the need for an individual to hold the umbrella, and allows freedom of movement in and out of the area where the umbrella provides its protection. However, anchoring traditional umbrellas can sometimes be difficult or cumbersome, especially if the ground surface into which the umbrella is tobe anchor is hard.

Various attempts have been made to provide devices for anchoring umbrellas into a ground surface. Anchoring devices have been suggested that are designed to be screwed into a ground surface on one end, and that another end in which to secure the bottom end of an umbrella. Such devices can be found in Andiarena, U.S. Pat. No. 5,906,077, Plourde, U.S. Pat. No. 5,457,918, Rodriguez et al., U.S. Pat. No. 5,535,978, Buttimore, U.S. Pat. No. 5,636,944, McDaniel, U.S. Pat. No. 5,662,304, Goldberg et al., U.S. Pat. No. D402,803, Perls, U.S. Pat. No. D371,901, and Tropiano, U.S. Pat. No. D394,544. A disadvantage of having a separate anchor into which an umbrella pole is inserted is that it is necessary to transport both the umbrella and the separate anchoring device to the point of use. Additionally, the orifice in the anchor into which the umbrella pole is to be inserted can become clogged with sand or such in the installation process.

Another beach umbrella anchoring means requires attaching the umbrella pole to a bucket-like anchor device and burying the anchor in the sand (Buttimore, U.S. Pat. No. 5,636,944). However, the '944 device is also a component separate from the umbrella itself. Another device suggested for anchoring umbrellas into a ground surface has provided an umbrella comprising an umbrella pole and one or more umbrella canopies, with an attached handle for forcing the umbrella standard into the ground surface. Griggs, U.S. Pat. No. 5,692,720. However, to anchor the umbrella disclosed in Griggs '720, one is taught to urge the umbrella pole into the ground surface by rotating while pushing downward on the pole, and depends on the strength of the user to accomplish its anchoring feature.

Another umbrella device is disclosed by Pesaturo, U.S. Pat. No. 2,759,486. The Pesaturo device includes a slide hammer mechanism. In the Pesaturo device, two anvils are affixed to the umbrella pole and a hammer is slideably disposed between them. Impacting the hammer upon either anvil allows the user to drive the umbrella pole into the ground surface, or upwardly force the umbrella standard from the ground surface. Pesaturo '486 however requires the addition of three heavy pieces of metal to the umbrella pole. This make the umbrella appreciably heavier and requires the user to devote more resources to carrying an umbrella with a hammer and two anvils in addition to other items that would normally be transported on an outing where such an umbrella is used.

It would be beneficial to have available a self-anchoring beach umbrella wherein the umbrella incorporates a means for facilitating the anchoring of the umbrella without requiring separate hardware or additional mass to accomplish.

SUMMARY OF THE INVENTION

The present invention solves a number of the problems inherent in the prior art by providing a self-anchoring beach umbrella comprising an umbrella canopy and an umbrella pole. The canopy is typical of such umbrella elements as are presently known in the art. The umbrella pole has an upper member for supporting the canopy and a lower member for self-anchoring the umbrella into a ground surface. The upper member is an elongated tubular sleeve having a first end communicating with and supporting the umbrella canopy. The upper member also contains a lumen disposed along the axis within the elongated tubular sleeve, and a second end for receiving a pole standard into the axial lumen. The lower member is a pole standard with a first end formed for insertion into the axial lumen of the elongated tubular sleeve. The pole standard has a second or anchor end formed for anchoring into the ground surface. A hammer is fixed to the elongated tubular sleeve for transmitting an axial force applied to the elongated tubular sleeve onto an anvil. The anvil is fixed to the pole standard for receiving the axial force from the hammer and transmitting the force to the pole standard to anchor the pole standard into the ground surface.

The axial lumen is formed inside of the tubular sleeve to coaxially and slideably receive the pole standard. The hammer and the anvil, respectively, are capable of transmitting and receiving a downward axial force of sufficient magnitude to drive the pole standard into the ground surface and provide an anchoring effect. The impact force of the hammer is developed by the mass of the upper member, either alone or in combination with the mass of the attached canopy.

The hammer can be formed inside the tubular sleeve and fixed to a wall of the lumen far from the second end of the sleeve with the anvil fixed at the first end of the pole standard. The anvil is slideably received into the lumen of the tubular sleeve and the tubular sleeve is slid down the length of the pole standard to cause the hammer to impact the anvil.

In an alternative embodiment the hammer is fixed at the second end of the tubular sleeve and configured to allow insertion of the first end of the pole standard into the lumen of the tubular sleeve. In this case the hammer may be configured as an annulus. Further, in this embodiment, the anvil is a collar fixed on an outer surface of the pole standard between the first and second ends of the pole standard, and disposed to receive the downward axial force from the hammer. Other alternative embodiments of the hammer and anvil are practicable by one of ordinary skill in the art.

Anchoring the self-anchoring umbrella into a ground surface involves positioning the second anchor end of the pole standard at the ground surface, then inserting the tubular sleeve coaxially over the pole standard to receive the pole standard into the lumen of the tubular sleeve. A downward axial force is then applied on the tubular sleeve to slideably receive the pole standard into the lumen of the tubular sleeve and to cause the hammer to impact the anvil. Impacting the hammer onto the anvil initiates penetration of the ground surface by the pole standard. Finally, reapplying the downward axial force on the tubular sleeve to repeatedly impact the hammer upon the anvil will cause the pole standard to be anchored into the ground surface.

Other and further features and advantages will be apparent from the following description of presently preferred embodiments of the invention, given for the purpose of disclosure when taken in conjunction with the accompanying drawings.

DETAILED DESCRIPTION OF THE INVENTION

Figure 1:
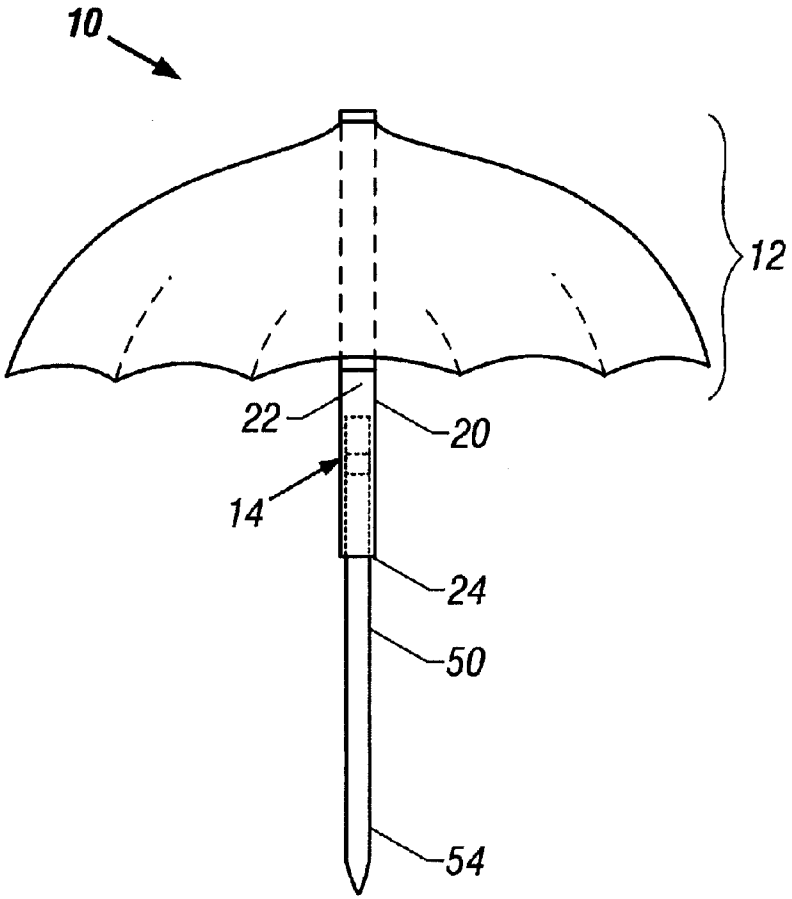
FIG. 1 is a schematic view of a typical self-anchoring beach umbrella of the present invention.

Referring now to the drawings, the details of preferred embodiments of the present invention are graphically and schematically illustrated. Like elements in the drawings will be represented by like numbers. FIG. 1, represents a typical embodiment of a self-anchoring beach umbrella 10 according to the present invention. The umbrella 10 includes an umbrella canopy 12 supported by an umbrella pole 14. The umbrella canopy 12 is typical of such canopies as are known in the art. The canopy 12 can include the elements and features that are typically found on such canopies, (including opening and closing means, tilting means, and similar umbrella canopy features. Such features and variations are known to and readily practicable by the ordinary skilled artisan. The umbrella pole 14 is comprised of an upper member 20 and a lower member 50. The umbrella canopy 12 is supported by the upper member 20 by a connection (not shown) to the upper member 20 at the upper member's first or canopy end 22. The connection to the canopy 12 to the canopy end 22 of the upper member 20 may be fixed, so that the canopy 12 and the upper member are integral. Alternatively, the connection may be separable, so that the canopy 12 and the upper member 20 can be attached or separate as desired.

The upper member 20 of the umbrella pole 14 is configured as an elongated tubular sleeve. The cross-section of the tubular sleeve 20 may be square, oval, oblong or shaped as practicable by one of ordinary skill in the art. In the preferred embodiment, the tubular sleeve 20 has a circular cross-section. The interior of the tubular sleeve defines an axial lumen 26.

Figure 3:
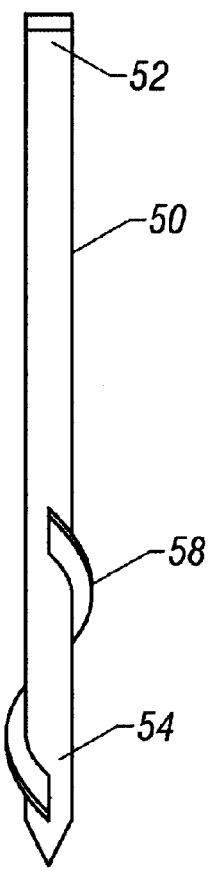
FIG. 3 is a side view of a lower member pole standard showing an anchor vane associated with the pole standard's anchor end.
Figure 2:
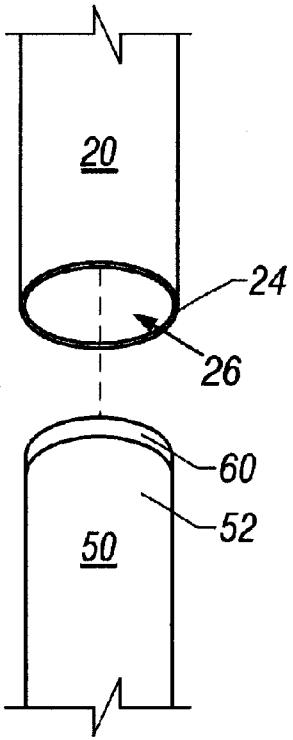
FIG. 2 is a perspective drawing showing the insertion of the lower member pole standard into the lumen of the tubular sleeve upper member of the umbrella pole.

As shown in FIG. 2, the lower member (pole standard) 50 of the umbrella pole 14 has a cross-section complementary to that of the upper member tubular sleeve 20. As shown in FIG. 3, the lower member or pole standard 50 has a pole standard first end 52 and a pole standard anchor end 54. The pole standard first end 52 is formed to be axially inserted into the lumen 26 of the tubular sleeve 20, whereas the pole standard anchor end 54 is shaped to facilitate ground surface penetration. In FIG. 3, the anchor end 54 is illustrated as pointed as a preferred embodiment. However, other configurations for the anchor end 54 are known and are practicable by the ordinary skilled artisan. The pole standard anchor end 54 may be modified to better facilitate its penetration of specific types of ground surfaces, or to accomplish a specific result. For example, as shown in FIG. 3, an otherwise plain pointed pole standard 50 is modified to include an anchor vane 58 to help prevent the pole standard from rotating once it is set into a ground surface. Although, only a single anchor vane 58 is shown, multiple such vanes may be practiced on a pole standard 50 anchor end 54. Ground surfaces being penetrated typically are sand, clay, soil, gravel and similar ground surfaces where it is desired to utilize the self-anchoring beach umbrella 10 of the present invention.

FIGS. 4A to 4E are cross-sectional views of a pole standard 50 received into a tubular sleeve 20. The various illustrations show different preferred means of accomplishing the hammer and anvil elements of the present invention. Using FIG. 4A as exemplary of these preferred embodiments, a hammer 40 is fixed within the lumen 26 of the tubular sleeve 20. The hammer 40 provides for transmitting an axial force (see FIG. 3A, arrow) applied to the tubular sleeve 20 onto the anvil 60 upon impact. The force of the impact is transmitted by the anvil 60 to the pole standard 50 by virtue of the anvil's fixed relationship to the pole standard 50. The force transmitted to the pole standard 50 acts to drive the pole standard anchor end 54 into the ground surface. The axial force transmitted by the hammer 40 is generated by the combined masses of the tubular sleeve 20 and hammer 40 as they are moved (at some rate, through some distance) to impact the anvil 60. If the umbrella canopy 12 is attached to the tubular sleeve 20, the combined mass is increased, and the potential axial force transmitted by the hammer 40 may be increased for the same movement.

Figures 4A, 4B, 4C, 4D, 4E:
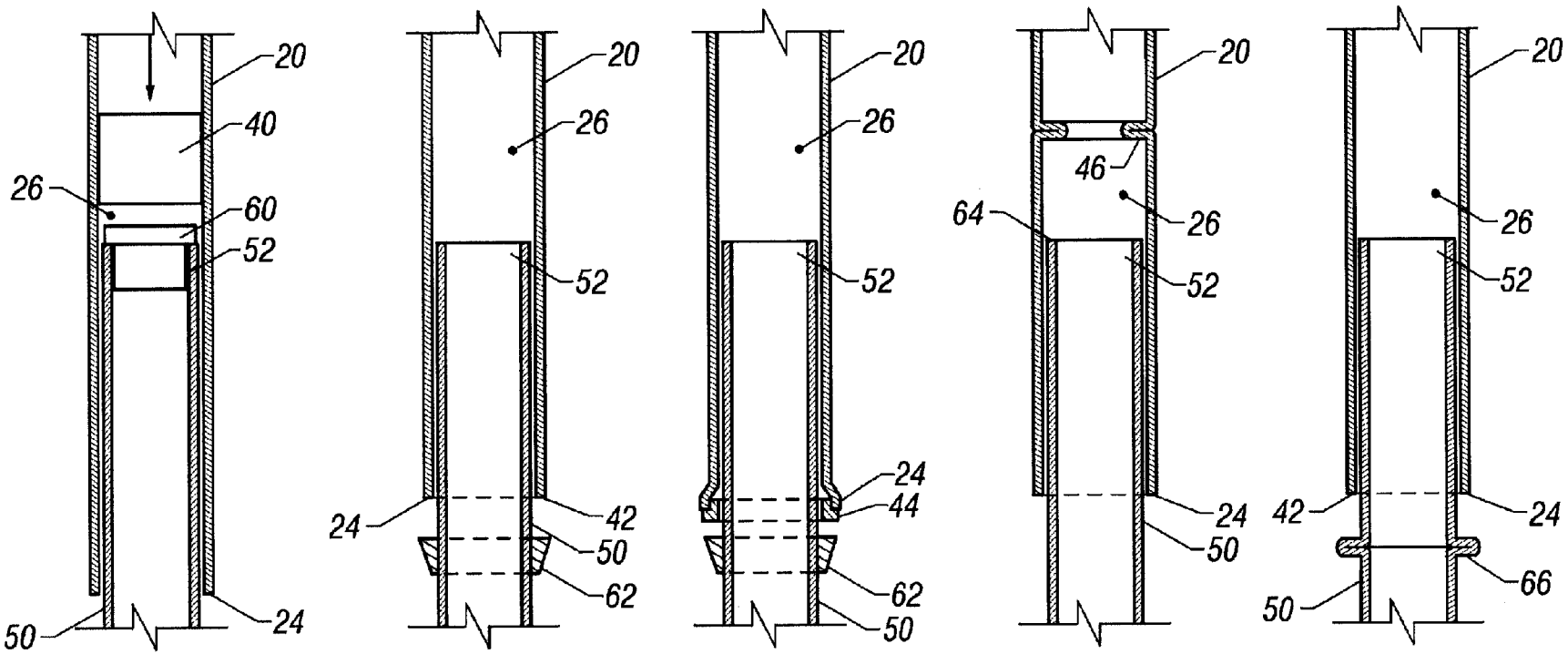
FIGS. 4A to 4E are cross-sectional views of the pole standard received into the tubular sleeve, and illustrates various embodiments of the hammer and anvil elements of the present invention.

In FIG. 4B, the hammer 42 is comprised of the rim of the tubular sleeve's 20 second end 24. The anvil 62 is a collar fixed to an outer surface of the pole standard 50 at a position distal from the pole standard upper end 52. Again in this embodiment, axial force is generated as described above, and when the tubular sleeve 20 is axially slid downward, the hammer 42 impacts a against the anvil 62 and the axial force is transmitted to the pole standard 50. FIGS. 4C to 4E similarly illustrate different preferred means accomplishing the hammer and anvil elements of the present invention and the generation and transmission of an axial force from the tubular sleeve 20 to the pole standard 50. In FIG. 4C, the tubular sleeve open end 24 is reinforced as might be necessary if a relatively large force must be transmitted by the hammer 44. In FIGS. 4D & 4E, the hammer 46 and the anvil 66 are accomplished by crimping the material of the tubular sleeve 20 or the pole standard 50 either internally or externally. Either of these configurations might be beneficial where the amount of force to be transmitted by a hammer is relatively small, such as when the ground surface to be penetrated is soft.

In operation, when the self-anchoring umbrella 10 is desired to be used, the pole standard anchor end 54 is positioned for anchoring at the ground surface. With the tubular sleeve 20 coaxially inserted over the pole standard 50, so that the pole standard is fully inserted into the lumen 26 of the tubular sleeve 20, the tubular sleeve 20 is raised an appropriate distance, and then urged back down over pole standard 50. The downward force applied to the tubular sleeve 20 causes the pole standard first end 52 to slideably reinsert into the lumen 26 of the tubular sleeve 20, and cause the hammer to impact the anvil. Accordingly, the force generated by the movement of the tubular sleeve 20 is transmitted via the hammer onto the anvil, and ultimately to the pole standard anchor end 54. To anchor the self-anchoring beach umbrella 10 into the ground surface, the axial force applied to the elongated tubular sleeve 20 should be sufficient for the pole standard anchor end 54 to penetrate the ground surface. To complete the anchoring process, the axial force repeatedly is applied to the tubular sleeve 20 so that the pole standard anchor end 54 is driven further into the ground surface to a depth sufficient to support and anchor the self-anchoring beach umbrella 10 in the desired manner. Sufficient anchoring of the self-anchoring beach umbrella 10 involves preventing the umbrella from tipping and the ability of the self-anchoring beach umbrella 10 to withstand expected wind gusts without becoming dislodged from the ground surface.

As is understood in the art, the various hammers and anvils of the present invention should be constructed of material that is capable of withstanding repeated and elevated impact forces. Typically, the axial force would be applied to the elongated tubular sleeve by a person grasping the tubular sleeve 20 or the umbrella canopy 12 (if attached) and raising the tubular sleeve 20 an appropriate distance, and then forcing the tubular sleeve 20 downward. An appropriate distance is a distance high enough to develop sufficient potential energy to drive the pole standard anchor end 54 into the ground surface, yet not so high as to extract the pole standard first end 52 from the lumen 26 of the tubular sleeve 20.

The present invention, therefore, is well adapted to carry out the objects and attain the ends and advantages mentioned, as well as others inherent therein. While presently preferred embodiments of the invention have been given for purposes of disclosure, numerous changes in the details of procedures for accomplishing the desired results will readily suggest themselves to those skilled in the art, and such changes are encompassed within the spirit of the present invention disclosed herein and the scope of the appended claims.

What is claimed is:

1. A self-anchoring beach umbrella comprising:

an umbrella canopy; and an umbrella pole having an upper member for supporting the canopy and a lower member for self-anchoring the umbrella into a ground surface;

the upper member being an elongated tubular sleeve having a first end communicating with and supporting the umbrella canopy, an axial lumen formed within the elongated tubular sleeve, and a second end for receiving a pole standard into the axial lumen;

the lower member being a pole standard having a length, a first end formed for insertion into the axial lumen of the elongated tubular sleeve, and a second end formed for anchoring into the ground surface;

a hammer fixed to the elongated tubular sleeve, the hammer for transmitting an axial force applied to the elongated tubular sleeve onto an anvil; and an anvil fixed to the pole standard for receiving the axial force from the hammer and transmitting it to the pole standard to anchor the pole standard into the ground surface.

2. The self-anchoring beach umbrella of claim 1 wherein the umbrella pole further comprises a tubular sleeve having an axial lumen formed inside of the tubular sleeve to coaxially and slideably receive a pole standard.

3. The self-anchoring beach umbrella of claim 1 wherein the umbrella pole further comprises the hammer and the anvil capable of transmitting and receiving a downward axial force of sufficient magnitude to anchor the pole standard into the ground surface.

4. The self-anchoring beach umbrella of claim 1, wherein the umbrella pole further comprises the hammer being inside the tubular sleeve and fixed to a wall of the lumen at a position distal from the second end of the sleeve; and the anvil fixed at the first end of the pole standard, the anvil for receiving an impact from the hammer when the pole standard is slideably received into the lumen of the tubular sleeve and the tubular sleeve is slid down the length of the pole standard.

5. The self-anchoring beach umbrella of claim 1, wherein the umbrella pole further comprises the hammer fixed proximate the second end of the tubular sleeve and disposed to allow insertion of the first end of the pole standard into the lumen of the tubular sleeve and the anvil being a collar fixed on an outer surface of the pole standard distal from the first end of the pole standard, and disposed to receive the downward axial force from the hammer.

6. A method of anchoring the umbrella pole of the self-anchoring umbrella of claim 1 into a ground surface comprising the steps of:

positioning the second end of the pole standard to be anchored at the ground surface;

inserting the tubular sleeve coaxially over the pole standard to receive the pole standard into the lumen of the tubular sleeve;

applying a downward axial force on the tubular sleeve to slideably receive the pole standard into the lumen of the tubular sleeve and cause the hammer to impact the anvil;

transmitting a force from an impact of the hammer with the anvil to the pole standard to anchor the pole standard into the ground surface;

reapplying the downward axial force on the tubular sleeve so that the hammer repeatedly impacts upon the anvil until the pole standard is anchored into the ground surface; and leaving the tubular sleeve in place over the pole standard to provide an umbrella pole anchored into the ground surface.

* * * * *